United States Patent [19]

Uchida

[11] 3,999,240

[45] Dec. 28, 1976

[54] CABLE CLEANING DEVICE

[75] Inventor: Tomio Uchida, Sagamihara, Japan

[73] Assignee: Caterpillar Mitsubishi Ltd., Tokyo, Japan

[22] Filed: Mar. 12, 1975

[21] Appl. No.: 557,822

[30] Foreign Application Priority Data

Mar. 15, 1974 Japan ..... 49-29033

[52] U.S. Cl. ..... 15/256.6; 15/104.04; 166/170

[51] Int. Cl.[2] ..... B08B 11/00

[58] Field of Search ..... 15/88, 97 R, 104.04, 15/118, 210 B, 256.6; 166/170, 173, 176; 242/100

[56] References Cited

UNITED STATES PATENTS

| | | | |
|---|---|---|---|
| 1,822,521 | 9/1931 | Fox et al. | 15/210 B X |
| 2,222,191 | 11/1940 | Zisman | 15/256.6 X |

FOREIGN PATENTS OR APPLICATIONS

| | | | |
|---|---|---|---|
| 584,711 | 9/1933 | Germany | 15/104.04 |

*Primary Examiner*—Edward L. Roberts
*Attorney, Agent, or Firm*—Phillips, Moore, Weissenberger, Lempio & Strabala

[57] ABSTRACT

A cable cleaning device equipped with a housing means having a through hole for a cable. The housing means is divisible in the direction of the diameter of the cable and accomodates therein a cleaning means of an elastomeric material composed of at least two segments and surrounding the peripheral surface of the cable. The segments of the cleaning means are movable in the direction of the cable diameter, and urged against the peripheral surface of the cable by a spring means within the housing means whereby the cleaning means comes into elastic engagement with the peripheral surface of the cable passing through the through hole and cleans the cable.

20 Claims, 8 Drawing Figures

CABLE CLEANING DEVICE

BACKGROUND OF THE INVENTION

This invention relates to a cable cleaning device, and more specifically, to a cable cleaning device for cleaning the surface of an electric cable which is secured, for example, to an electric cable winder of an electrically driven earthmoving vehicle.

U.S. Pat. No. 3,632,906 and U. S. patent application Ser. No. 383,884, now U.S. Patent No. 3,861,505, for example, disclose an electrically driven earthmoving vehicle equipped with a winder for winding and unwinding a cable for power supply. Such an earthmoving vehicle is frequently operated in tunnels where underground water flows, and therefore, muddy soils, sands and clays tend to adhere heavily to the cables. These muddy soils and sands adhere to the cable and are carried over the cable guiding rollers provided at the cable receiving end of the winder or into the inside of the winder when the cable is wound up by the winder. The muddy matter carried to the rollers quickens the wearing of the rollers or injures them, and on the other hand, that carried into the inside of the winder is accumulated there and may cause a malfunction of the winder. Even when this is not the case, the muddy sands and soils become hardened upon drying, and it is not easy to clean them up. It has therefore been desired to avoid all these troubles by cleaning electric cables before wind-up on winders.

SUMMARY OF THE INVENTION

Accordingly, it is a primary object of this invention to provide a simple and effective cable-cleaning device for cleaning electric cables to be wound up on a cable winder.

Another object of this invention is to provide a cable cleaning device whose cleaning, repair and part exchange are easy.

Still another object of this invention is to provide a cable cleaning device which has a very simple structure, and is therefore cheap in the cost of production.

Still another object of this invention is to provide a cable cleaning device capable of cleaning the surface of an electric cable without injuring it.

A further object of this invention is to provide a cable cleaning device which can be easily fitted to a cable winder and does not adversely affect the function of the cable winder.

These and other objects are achieved by a cable cleaning device, in accordance with this invention, comprises a housing means having a hole for passing a cable therethrough, said housing means being divisible in the direction of the diameter of the cable; a cleaning means made of an elastomeric material composed of at least two segments, said cleaning means being accomodated within said housing means and encircling the periphery of said cable, said segments being movable at least in the direction of the cable diameter; and a spring means within said housing means for urging the segments of said cleaning means against the periphery of the cable.

According to the cable cleaning device of this invention, the cleaning means is engaged elastically with the peripheral surface of the cable when a cable to be wound up on the cable winder passes through the hole of the housing means. This results in the removal of an adhering matter such as soils and sands from the cable.

The degree of engaging of the cleaning means with the peripheral surface of the cable can be determined to one suitable for cleaning the cable without injuring its peripheral surface by properly choosing the shape and material of the segments of the cleaning means and the urging force of the spring means. Since the cable cleaning device of this invention is divisible in the direction of the diameter of the cable, it can be cleaned, repaired, and exchanged very easily.

In order for the cable cleaning device of this invention not to affect the winding and unwinding operations of the cable winder adversely, it is preferred that one end of the cable cleaning device be connected pivotably to the cable winder, and the other end be secured to the cable winder by means of a supporting member connected pivotably to this device.

The cable cleaning device can also include at least two housing means each accomodating the cleaning means and the spring means therein.

The invention will become more apparent from the following description of some preferred embodiments of this invention taken together with the accompanying drawins.

DETAILED DESCRIPTION OF PREFERRED EMBODIMENTS

Figure 1:
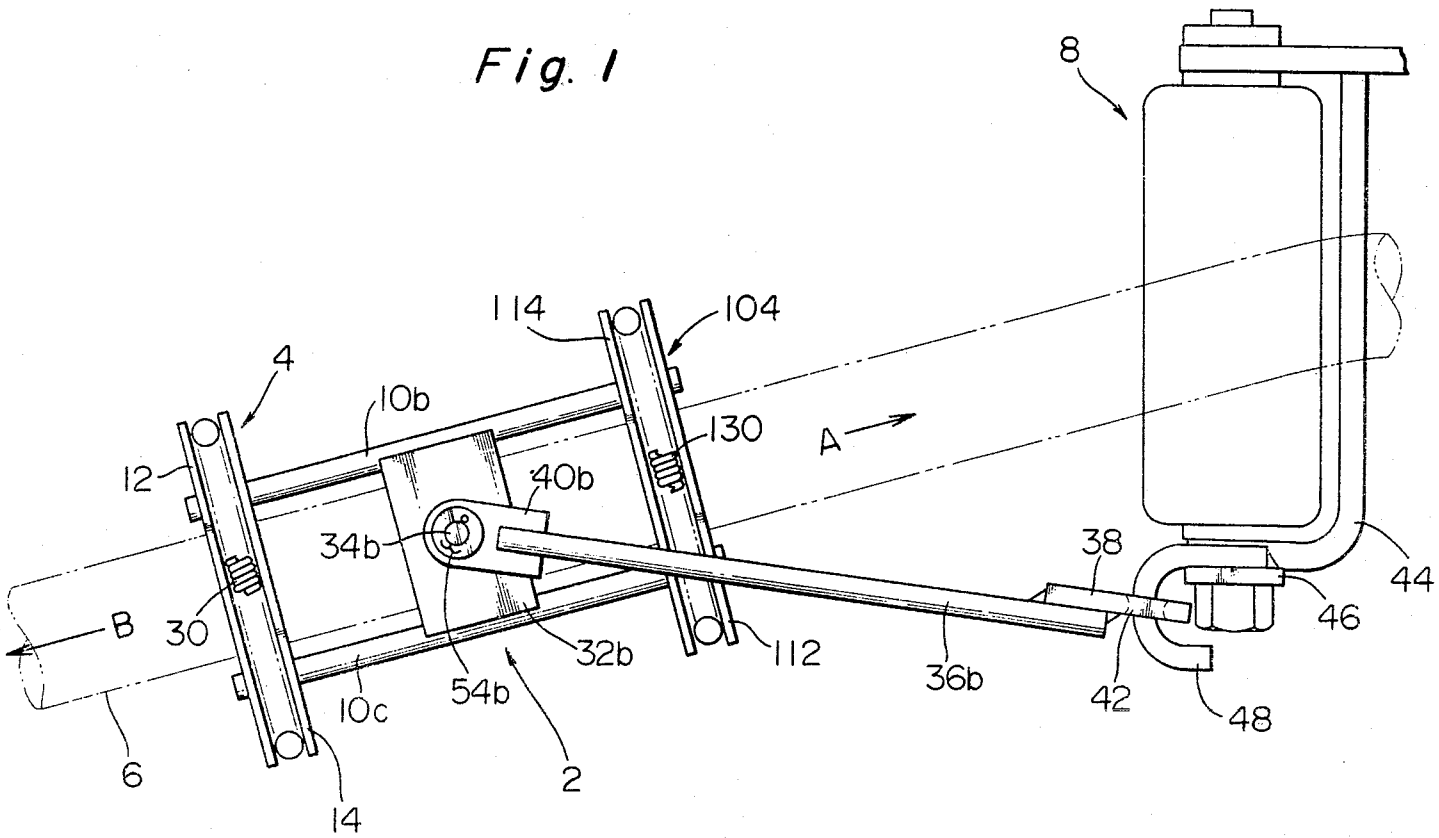
FIG. 1 is a side elevation of a cable cleaning device in accordance with this invention which is secured to a cable guiding roller assembly.

FIG. 1 illustrates a cable cleaning device 2 in accordance with this invention which includes two housing means 4 and 104. The cable cleaning device 2 is secured to a guide roller assembly 8 provided at the cable receiving end of a winder (schematically illustrated at W in FIG. 7) mounted in an electrically driven earthmoving vehicle (not shown) described in U.S. Pat. No. 3,861,505, in order to clean a power supplying cable 6 of the vehicle.

Figure 2:
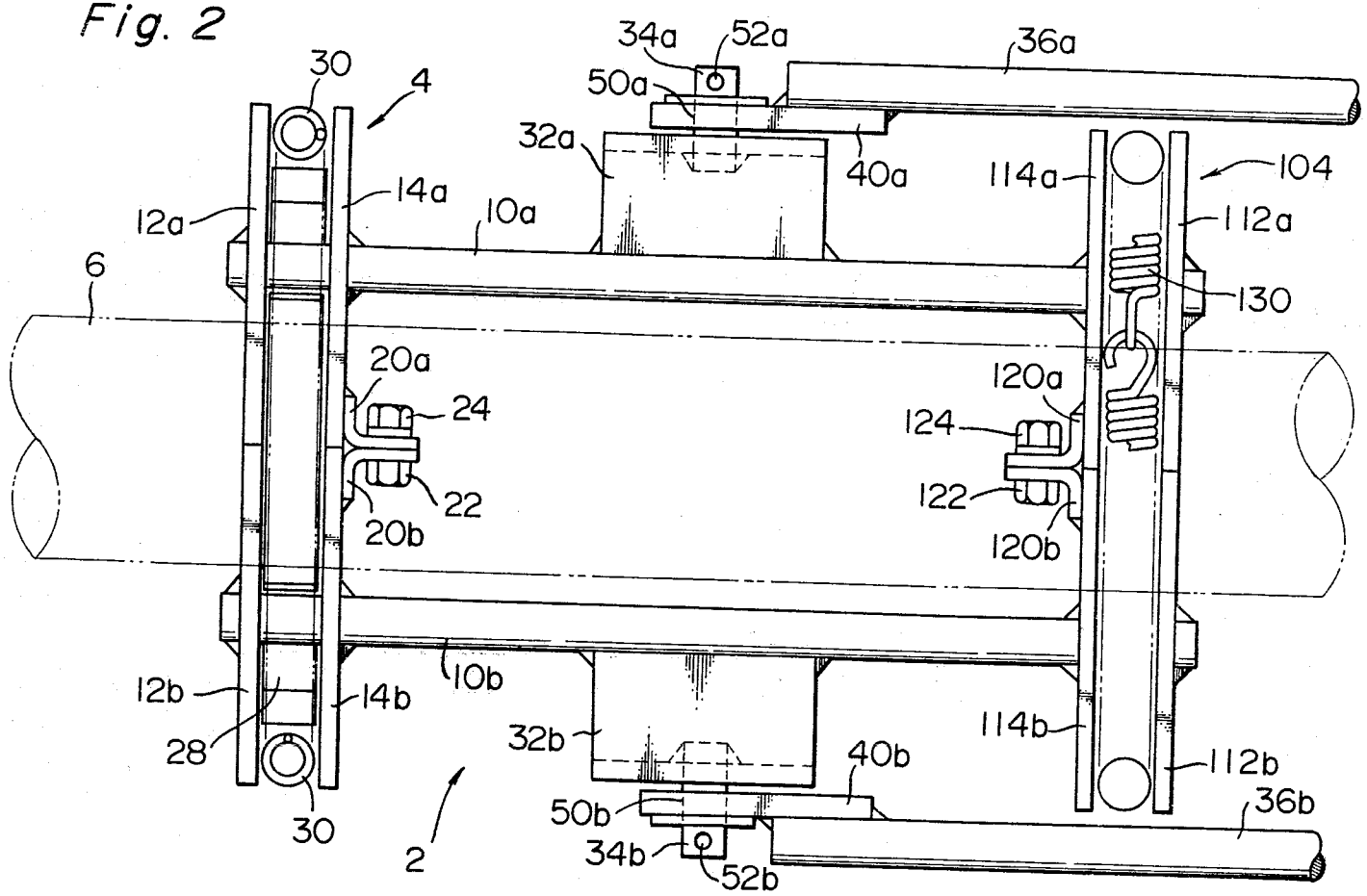
FIG. 2 is an enlarged plan of the cable cleaning device shown in FIG. 1.
Figure 4:
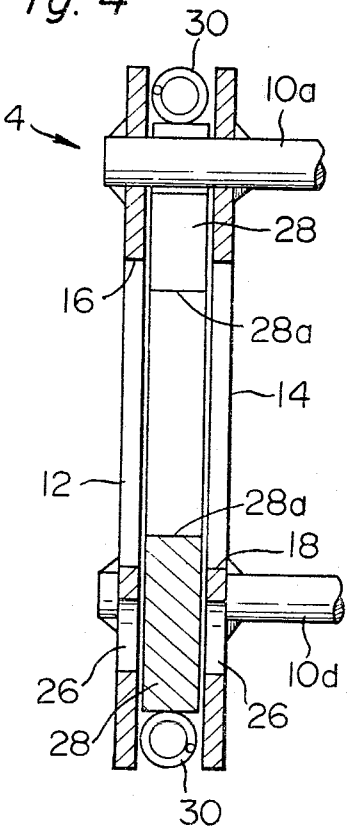
FIG. 4 is a sectional view taken along the line IV—IV of FIG. 3.
Figure 3:
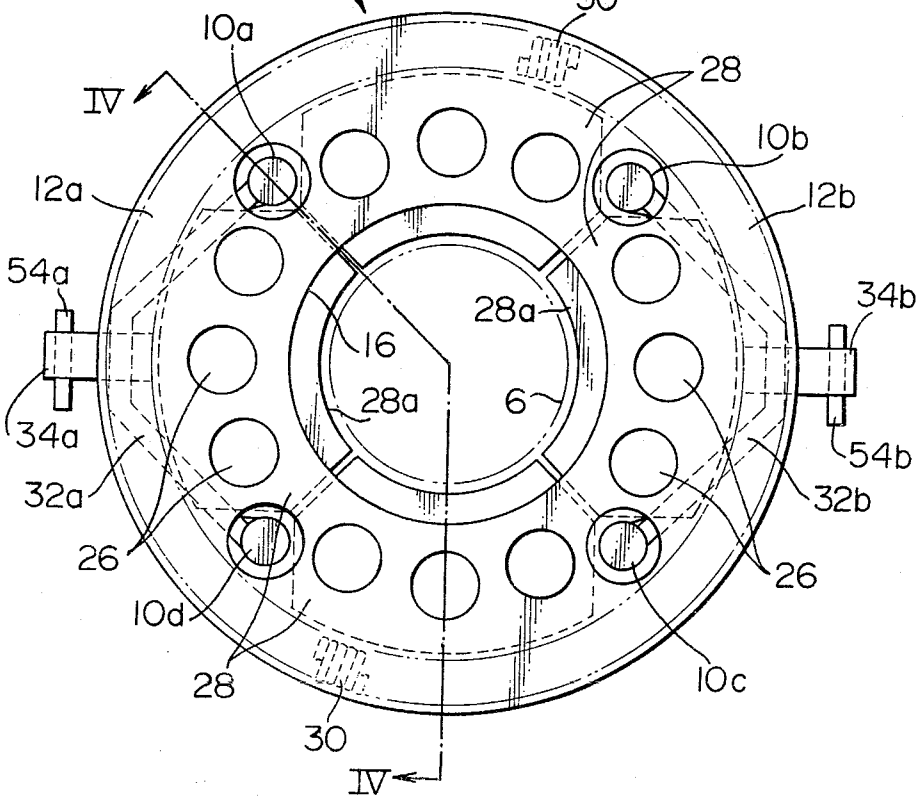
FIG. 3 is an enlarged end view of the cable cleaning device shown in FIG. 1.

Referring in particular to FIGS. 2 to 4, one embodiment of the cable cleaning device will be described in detail. The two housing means 4 and 104 are linked to each other by, for example, four connecting rods or pipes 10*a*, 10*b*, 10*c* and 10*d*. The housing means 4 is made up of a pair of annular plates 12 and 14 parallel-spaced from each other by a certain distance. Each of the annular plates 12 and 14 has a hole 16 and a hole 18 respectively at its center for passing the cable 6 to be cleaned therethrough. Preferably, each of the holes 16 and 18 has a diameter greater than the outside diameter of the cable 6 to an extent sufficient to prevent the peripheral surface of the cable 6 from contacting the inner circumference of the annular plate. The annular plate 12 is of a divisible type made of a semi-annular plate 12*a* and a semi-annular plate 12*b*. Likewise, the annular plate 14 is of a divisible type made of semi-annular plates 14*a* and 14*b*. The semi-annular plate 12*a* and the semi-annular plate 12*b* are fixed respectively to connecting rods 10*a* and 10*d* extending therethrough and to connecting rods 10*b* and 10*c* extending therethrough by welding or other suitable means. Similarly, the semi-circular plate 14*a* and the semi-cricular plate 14*b* and the semi-cricular plate 14*b* are fixed respectively to connecting rods 10*a* and 10*d* extending therethrough and to connecting rods 10*b* and 10*c* extending therethrough by welding or other suitable means. Generally L-shaped brackets 20*a* (only one of them is shown in the drawings) are fixed to the semi-annular plate 14*a* at portions near both ends approaching the semi-circular plate 14*b* by welding or other suitable means. The semi-circular plate 14*b* also includes brackets 20*b* (only one of them is shown in the drawings) at positions corresponding to the brackets 20*a* by welding or other suitable means. The brackets 20*a* and 20*b* have formed therein a hole for inserting the bottom portion of a clamping bolt therethrough. The brackets 20*a* and 20*b* are separably connected by a bolt 22 extending therethrough and a nut 24 fitting thereon. If desired, similar brackets can be provided in the semi-annular plates 12*a* and 12*b* although this is not shown in the embodiments illustrated in the accompanying drawings.

It will be readily appreciated from the above description that the housing means 4 constructed of the annular plates 12 and 14 has a hole through which to pass the cable 6 to be cleaned, and that the housing means 4 can be easily separated into a portion consisting of the semi-annular plates 12*a* and 14*a* fixed by the connecting rods 10*a* and 10*d* and a portion consisting of the semi-annular plates 12*b* and 14*b* fixed to the connecting rods 10*b* and 10*c*.

Preferably, each of the annular plates 12 and 14 have formed therein a plurality of outlet holes 26 arranged, for example, in a circlar form so that soils and sands that have come into the housing means can be released from these holes.

Figure 5:
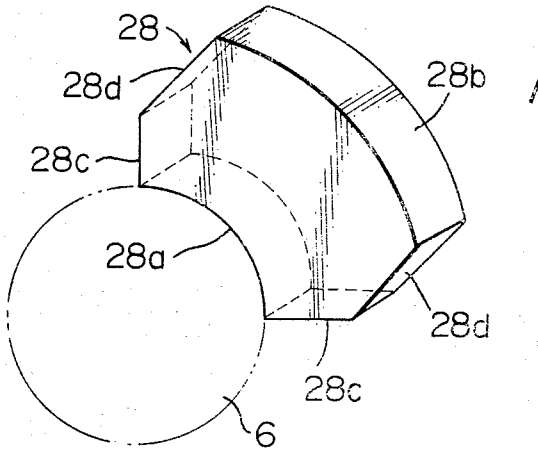
FIG. 5 is an enlarged perspective view of a segment of the cleaning means.

In the inside of the housing means 4, that is, between the annular plates 12 and 14, a cleaning means made of an elastomeric material of a low coefficient of friction, such s polyamides or polytetrafluoroethylene, is accomodated. In the embodiment shown in the drawings, the cleaning means is made of four generally fan-like segments 28. As is shown best in FIG. 5, each of the segments 28 includes an inner curved surface 28*a* an outer curved surface 28*b*, first inclined side surfaces 28*c* and second inclined side surfaces 28*d*. These segments 28, as best shown in FIG. 3, are inserted in the housing means 4 so that is surrounds the peripheral surface of the cable 6.

The segments 28 are disposed in the housing means 4 in such a relation that the first inclined side surfaces 28*c* of one segments make contact with, or approach, those of adjoining segments, and the inner curved surfaces 28*a* of the segments surround the peripheral surface of the cable 6. Since each of the segments 28 includes second inclined side surfaces 28*d*, the segments 28 can be easily inserted in the housing means without being impeded by the connecting rods 10*a* to 10*d* even after the housing means has been assembled around the cable 6. It is preferred that each of the segments 28 have a width somewhat shorter than the distance between the annular plates 12 and 14 so that within the housing means 4, it can easily move in the direction of the diameter of the cable 6, that is, in the direction in which the inside curved surfaces move to and away from the outer peripheral surface of the cable 6. Preferably, when a generally annular cleaning means is constructed of the four segments by contacting the first inclines surfaces 8*c* of each segment with those of the adjoining segments, the circular hole formed at its center by the inside curved surfaces of the segments has a diameter equal or nearly equal to the outside diameter of the cable 6. In the illustrated embodiment, the cleaning means is composed of four segments, but it can also be composed of two or more segments that can be accomodated within the housing means so as to surround the peripheral surface of the cable 6.

The housing means 4 also includes a spring means for urging the segments 28 against the inside of the cable 6 in the direction of its diameter and engaging the inside curved surfaces 28*a* of these segments elastically with the peripheral surface of the cable 6. In the illustrated embodiment, this spring means is an ordinary coil spring 30 having a connecting hook at both ends (FIG. 2) to connect such ends to each other. The spring 30 which surrounds the periphery or outer curved surfaces 28*b* of the segments 28 with its ends connected to each other urges the segments 28 to the inside of the cable in the direction of its diameter by its spring action, and engages the inner curved surfaces 28*a* of the segments 28 elastically to the peripheral surface of the cable 6.

The housing means 104 is substantially equivalent to the housing means 4 described in detail above. The housing means 104 also accomodates cleaning means and spring means therein. In the drawings, the constituent elements of the housing means 104 are designated by adding 100 to the reference numerals indicating the corresponding constituent elements of the housing means 4.

Figure 6:
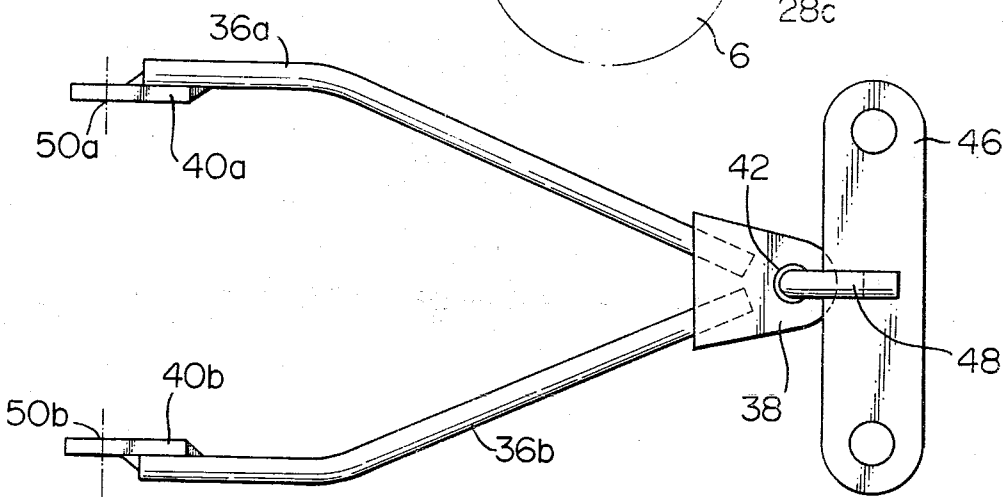
FIG. 6 is a plan showing a supporting means for securing the cable cleaning device of this invention to a cable guiding roller asembly.

Now, with particular reference to FIGS. 1, 2 and 6, the fitting of the cable cleaning device 2 of this invention to the cable winder will be described.

In the cable cleaning device 2 shown in the drawings, an angular bracket 32*a* is fixed to the connecting rods 10*a* and 10*d*, and an angular bracket 32*b* , to the connecting rods 10*b* and 10*c*, between the housing means 4 and the housing means 104 by welding or some suitable means. To the top of each of the angular brackets 32*a* and 32*b* is fixed a pin 34*a* or 34*b* respectively by welding or other suitable means. A pair of supporting rods 36*a* and 36*b* for securing the cable cleaning device 2 to the winder include a common fixing member 38 fixed to one end of each of these rods by welding or some suitable means, as best shown in FIG. 6. The other ends of the supporting rods 36*a* and 36*b* which extend in a bifurcated fashion from the fixing member 38 have fixing members 40*a* and 40*b* secured thereto respectively by welding or other suitable means. The common fixing member 38 has a hole 42 through which it is connected removably and rotatably to a hook 48. The hook 48 is fixed to a plate 46 by welding or some other suitble means by means of a bolt or the like which plate 46 is fixed to a supporting frame of the guide roller assembly 8 provided at the cable receiving end of the winder. The fixing members 40*a* and 40*b* secured to the other ends of the supporting rods 36*a* and 36*b* respectively have holes 50*a* and 50*b*, and are connected removably and rotatably to the angular brackets 32*a* and 32*b* as a result of the holes 50*a* and 50*b* receiving the pins 34*a* and 34*b* respectively. These fixing members 40*a* and 40*b* are held in predetermined positions by inserting split cotter pins 52*a* and 52*b* in holes 52*a* and 52*b* formed in the pins 34*a* and 34*b*.

When the supporting rods 36*a* and 36*b* are connected to the angular brackets 32*a* and 32*b*, it is preferred that the fixing members 40*a* and 40*b* be connected to the pins while increasing the distance between the fixing members 40*a* and 40*b* by bending the supporting rods 35*a* and 36*b* elastically.

In the illustrated embodiment, the supporting rods 36*a* and 36*b* are connected rotatably to the guide roller assembly and also to the cable cleaning device 2. This is especially preferred when the cable cleaning device is used in a winder of an electrically driven earthmoving vehicle. The reason is that when the earthmoving vehicle rotates to the right or left, the cable 6 moves relatively to the vehicle or winder in a perpendicalar direction in FIG. 1, and when the cable is wound or unwound by the forward or backward movement of the vehicle, the cable moves relative to the winder. But if the connection of the supporting rods to the guide roller assembly and the connection of the supporting rods to the cable cleaning device are such that the rods are swingable, the cable cleaning device does not at all impede the movement of the cable, and therefore, does not impede the function of the winder and the operability of the vehicle.

The operation of the cable cleaning device 2 illustrated in FIGS. 1 to 6 is believed to be clear on the whole from the above description. However, the description of the operation will be summarized below with particular reference to FIGS. 1, 2 and 3.

When the cable 6 is wound by the action of the winder W (FIG. 7), it is moved in a direction shown by arrow A, and when it is unwound, it is moved in a direction of arrow B. When the cable 6 moves in the direction of arrow B, the cleaning means engaged elastically with the peripheral surface of the cable 6 accomodated in the housing means 4 and 104 slides relative to the peripheral surface of the cable 6 to scrape off the matter adhering to the peripheral surface of the cable 6, such as soils and sands. As the diameter of the hole provided at the center of the housing means is far larger than the outside diameter of the cable 6, the peripheral surface of the cable 6 makes contact only with the cleaning means and not with the housing means. Accordingly, the sheath of the cable 6 is not impaired by contact with the housing means. Since the cleaning means is made of an elastomer with a low coefficient of friction, and is engaged elastically with the peripheral surface of the cable 6 by spring means, it does not contact the sheathing of the cable 6 excessively frictionally, but adheres to it intimately, and slides relative to the cable 6. This prevents the cleaning means from impairing the sheathing of the cable 6, and effectively scrapes off the matter adhering to the sheathing of the cable 6. Even when the outside diameter of the cable 6 increases or decreases temporarily, the cleaning means can maintain its elastic engagement with the peripheral surface of the cable 6 and clean it effectively, because it can move always in the direction of the diameter of the cable 6. Since the width of the segment 28 is smaller than the distance between the annular plates 12 and 14 constituting the housing means, the segments 28 can move in the direction of the diameter of the cable 6 without making an excessively frictional contact with the inside surface of the annular plates 12 and 14. The soils and sands adhering to the cable 6 may enter the space between the segments and the annular plates because the width of the segment 28 is smaller than the distance between the annular plates 12 and 14. However, they are effectively eliminated from the outlet holes 26 provided in the annular plates.

In the illustrated embodiment, two housing means 4 and 104 are provided. In this case, it is possible to render the force of the spring means within the housing means 4 (which is farther from the winder) weaker than that of the spring means in the housing means 104 (which is near to the winder), and therefore, to render the force of engagement between the cleaning means of the housing means 4 and the peripheral surface of the cable 6 weaker than that of engagement between the cleaning means of the housing means 104 and the peripheral surface of the cable 6. This enables the peripheral surface of the cable 6 to be first cleaned roughly, and then neatly, when the cable 6 is wound upon the winder. Even when there is only one housing means, the cable can be cleaned effectively to a feasible extent, and if desired, three or more housing means can be provided. The material of the cleaning means and the spring force of the spring means can be properly selected according to the material of the sheathing of the cable or the environment in which the cable is used.

It is very easy to repair or clean the cable cleaning device itself, and the exchange of component parts of the cleaning device is also very easy. The spring means and cleaning means can be easily taken out from the housing means without disassembling the housing means. In the illustrated embodiment, the spring means 30 can be removed merely by disengaging the connecting hooks at its both ends. It will be obvious that if the spring means 30 is removed, the segments 28 of the cleaning means can also be removed with simplicity, and so can be the housing means. In order to disassemble the housing means, the split cotter pins inserted in the holes 52*a* and 52*b* of the pins 34*a* and 34*b* are first removed to release the connection of the supporting rods 36*a* and 36*b* to the angular brackets 32*a* and 32*b*. Then, the bolt 22 and the nut 24 connecting the semi-annular plates 14*a* and 14*b* are removed. This results in the division of the housing means into two assembly units. These units can be re-assembled by performing the above disassembling operation in the reverse order.

Figure 7:
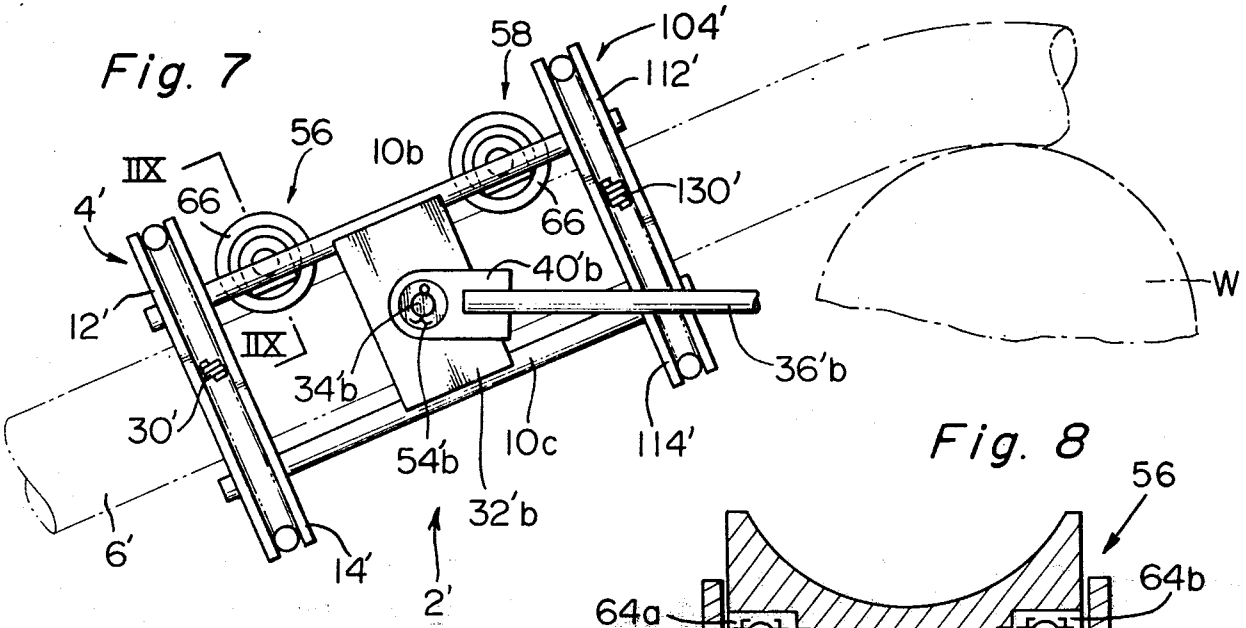
FIG. 7 is a side elevation of another embodiment of the cable cleaning device which is equipped with a cable guiding means.
Figure 8:
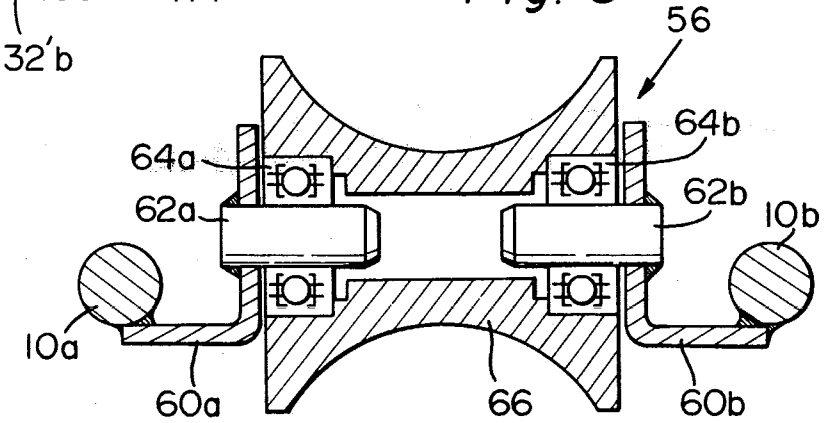
FIG. 8 is a sectional view of the cable guiding means taken along the line IIX—IIX of FIG. 7.

FIGS. 7 and 8 show a modified embodiment of the cable cleaning device of this invention. This embodiment differs from the embodiment shown in FIGS. 1 to 6 in that a cable guide means is provided between two housing means. Therefore, those constituent parts of the embodiment in FIGS. 7 and 8 are designated by attaching primes to the reference numerals of the corresponding parts in the embodiment shown in FIGS. 1 to 6.

In the embodiment shown in FIGS. 7 and 8, two cable guide means 56 and 58 are provided between the housing means 4' and the housing means 104'. Since the cable guide means 56 and 58 are substantially equivalent to each other, the cable guide means 56 will be described below.

As is clearly shown in FIG. 8, the cable guide means 56 includes L-shaped brackets 60*a* and 60*b* fixed respectively to connecting rods 10'*a* and 10'*b* by welding or some other suitable means between the housing means 4′ and the angular brackets. A short shaft 62*a* and a short shaft 62*b* are fixed respectively to the L-shaped bracket 60*a* and the L-shaped bracket 60*b* by welding or by some other means so that the axial lines of the short shafts 62*a* and 62*b* in the longitudinal direction extend in a straight line. A hollow guide roller 66 is rotatably provided in the short shafts 62*a* and 62*b* through bearing means 64*a* and 64*b*. The outside surface of the guide roller 66 is of an inwardly curved shape having the substantially same curvature as that of the peripheral surface of the cable. Accordingly, in spite of the fact that the guide roller 66 is so disposed that its axial line in the longitudianl direction is at right angles to the moving direction of the cable 6′, the outside surface of the guide roller 66 makes a rolling linear contact with the peripheral surface of the cable.

The guideroller 66 can be easily removed by separating the housing means 4′ and 104′, namely by moving the connecting rods 10′*a* and 10′*b* in a direction in which they become separated from each other. When reconstructing the housing 4′ and 104′, the short shafts 62*a* and 62*b* can be easily re-mounted.

Accordingly to the cable cleaning device 2′ shown in FIGS. 7 and 8 which is provided with the cable guide means 56 and 58, when the cable 6′ moves by being wound or unwound upon or from the winder, the peripheral surface of the cable 6′ makes a linear contact with the outside surfaces of the guide rollers of the cable guide means 56 and 58 thereby to guide the cable 6′. Thus, cable 6′ moves very smoothly without moving upwardly between the housing means 4′ and the housing means 104′. The own weight of the cable cleaning device 2′ by the cable 6′ as a result of the cable means 56 and 58 making contact with the peripheral surface of the cable 6′. This ensures a uniform elastic engagement of the cleaning means accomodated in the housing means 4′ and 104′ with the entire peripheral surface of the cable 6′.

In the embodiment illustrated in FIGS. 7 and 8, cable guide means are provided only above the cable 6′ at the connecting rods 10′*a* and 10′*b*. Similar cable guide means can also be provided in connecting rods 10′*d* and 10′*c* and below the cable 6′ so as to guide the cable 6′ both from above and below. Furthermore, in the embodiment shown in FIGS. 7 and 8, the number of cable guide means provided between the housing means 4′ and 104′ can be changed to 1 or if desired, to 3 or more.

Whilst the invention has been described in detail above with resference to some preferred embodiments, it is apparent that the invention is not limited to these specific embodiments, but various modifications and changes are possible without departing from the spirit and scope of the invention.

What we claimed is:

1. In combination with a cable winder having a cable, a cable cleaning device comprising a housing means having a hole for passing the cable therethrough, said housing means being composed of a pair of annular plates parallel-spaced from each other and each being divisible in the direction of the diameter of the cable; a cleaning means made of an elastomeric material composed of at least two segments, said cleaning means being accommodated within said housing means and encircling the periphery of said cable, said segments being movable at least in the direction of the cable diameter; and a spring means within said housing means for urging the segments of said cleaning means against the periphery of the cable.

2. The cable cleaning device of claim 1 wherein the width of said cleaning means is smaller than the distance between the two annular plates.

3. The cable cleaning device of claim 2 wherein each of said annular plates has plurality of outlet holes adapted to permit the egress of material therethrough which collects in said housing means.

4. The cable cleaning device of claim 1 wherein said segments form an annular member having a hole in its center.

5. The cable cleaning device of claim 4 wherein the diameter of the hole of said annular member is substantial equal to the outside diameter of the cable.

6. The cable cleaning device of claim 1 wherein said segments are made of polyamide resin.

7. The cable cleaning device of claim 1 wherein said segments are made of polytetrafluoroethylene.

8. The cable cleaning device of claim 1 wherein said spring means is a coil spring wrapped around said cleaning means.

9. The cable cleaning device of claim 1 wherein said segments form an annular member having a hole at its center, and said spring means is a coil spring wrapped around the peripheral surface of said annular member.

10. The cable cleaning device of claim 1 wherein said device is connected to said cable winder by supporting rods with one end connected rotatably to said device and the other connected rotatably to the cable winder.

11. A cable cleaning device comprising at least two housing means each having a through hole for a cable and arranged in spaced relationship, said housing means being connected to each other by connecting rods, and each of said housing means being divisible in the direction of the diameter of the cable; a cleaning means composed of an elastomeric material and consisting of at least two segments, said cleaning means being accomodated in each of said housing means and surrounding the peripheral surface of the cable, and said segments being movable at least in the direction of the diameter of the cable; and a spring means within each of said housing means for urging the segments of said cleaning means against the peripheral surface of the cable.

12. The cable cleaning device of claim 11 which further includes a cable guide means provided in said rods between said housing means for guiding a cable between said housing means.

13. The cable cleaning device of claim 12 wherein said cable guide means is supported rotatably on said connecting rods and includes rollers whose surfaces make contact with the peripheral surface of the cable.

14. The cable cleaning device of claim 13 wherein said rollers are so positioned that their axial lines in the longitudinal direction are at right angles to the moving direction of the cable, and the surfaces of said rollers have an inwardly curved shape having substantially the same curvature as that of the peripheral surface of the cable, and make a rolling linear contact with the peripheral surface of said cable.

15. The cable cleaning device of claim 11 wherein the urging force of one spring means is lower than that of the other.

16. The cable cleaning device of claim 11 which is fitted to a winder by supporting rods with one end rotatably connected to said connecting rods and the other rotatably connected to the winder.

17. The cable cleaning device of claim 11 wherein each of said housing means is composed of a pair of parallel-spaced annular plates each of which is divisible, said segment form an annular member having a hole at its center, and each of said spring means is a coil spring wrapped around each of said cleaning means.

18. The cable cleaning device of claim 17 wherein the width of said cleaning means is smaller than the distance between said pair of annular plates, and each of said annular plates has a plurality of outlet holes.

19. In combination with a cable winder having a cable, a cable cleaning device comprising a housing means having a hole for passing the cable therethrough, said housing means being divisible in the direction of the diameter of the cable; a cleaning means made of an elastomeric material composed of at least two segments, said cleaning means being accommodated within said housing means and encircling the periphery of said cable, said segments being movable at least in the direction of the cable diameter; and a coil spring within said housing means and wrapped around said cleaning means for urging the segments of said cleaning means against the periphery of the cable.

20. In combination with a cable winder having a cable, a cable cleaning device comprising a housing means having a hole for passing the cable therethrough, said housing means being divisible in the direction of the diameter of the cable; a cleaning means made of an elastomeric material composed of at least two segments, said cleaning means being accommodated within said housing means and encircling the periphery of said cable, said segments being movable at least in the direction of the cable diameter; and a spring means within said housing means for urging the segments of said cleaning means against the periphery of the cable, said cleaning device fitted to said cable winder by supporting rods rotatably interconnected therebetween.

* * * * *